United States Patent [19]

Whitten, Jr.

[11] 3,972,077

[45] Aug. 3, 1976

[54] SWIMMING POOL ROPE ANCHOR

[76] Inventor: George R. Whitten, Jr., 11 Highland Ave., Bellingham, Mass. 02019

[22] Filed: May 27, 1975

[21] Appl. No.: 580,672

[52] U.S. Cl. ..... 4/172; 4/172.18; 52/704; 52/706

[51] Int. Cl.[2] ..... E04H 3/16; E04H 3/18; F16L 21/02

[58] Field of Search ..... 4/172, 172.11, 172.12, 4/172.15, 172.17, 172.18, 172.19; 52/704, 706, 707

[56] References Cited

UNITED STATES PATENTS

| | | | |
|---|---|---|---|
| 3,005,292 | 10/1961 | Reiland | 52/704 X |
| 3,065,576 | 11/1962 | Prizler et al. | 4/172.15 X |
| 3,159,945 | 12/1964 | La Morte | 52/706 |
| 3,298,148 | 1/1967 | Dickson | 52/706 X |
| 3,550,343 | 12/1970 | Buske | 52/704 |

*Primary Examiner*—Henry K. Artis

*Attorney, Agent, or Firm*—Thompson, Birch, Gauthier & Samuels

[57] ABSTRACT

A rope anchor is disclosed for use on a metal wall at the periphery of a swimming pool. The anchor comprises an assembly of a one-piece molded anchor body, an anchor link and a pin. The anchor body has a front flange surrounding an opening which leads to a recess in a rearwardly protruding back section. The back section is adapted to be received in a hole in the aforesaid metal wall, and the recess is suitably dimensioned to receive and contain the anchor link. The pin is adapted for removable insertion through both the back section and the anchor link in the recess, with the ends of the thus inserted pin cooperating with the front flange to grip the metal wall therebetween. The anchor link is movable between an operative position extending beyond the face of the front flange and into the pool, and an inoperative position behind the same face, with an inclined supporting ledge being provided in the recess for urging the link into the inoperative position when the rope anchor is not in use.

7 Claims, 3 Drawing Figures

SWIMMING POOL ROPE ANCHOR

BACKGROUND OF THE INVENTION

This invention relates generally to swimming pools, and more particularly to an improved rope anchor for use therewith.

In swimming pools, the hooked ends of the lane markers and other rope-like devices are attached to rope anchors. The rope anchors which are currently in use or which are otherwise known to have been developed previously are generally deficient, primarily because of the difficulty and expense involved in their initial installation and/or subsequent repair. These problems are particularly characteristic of, although not limited to, rope anchors designed to be embedded in masonry pool walls. An example of this type of rope anchor is provided by the disclosure in U.S. Pat. No. 3,065,576 (Prizler, et al).

Such rope anchors must be installed by masons or other skilled construction personnel which in and of itself makes their use expensive. Moreover, should the rope anchors become damaged after installation, an occurrence which is not unusual, particularly in large pool installations, then their repair or replacement becomes even more time consuming and expensive. This is due to the fact that the masonry in which the anchors are embedded must first be chipped away and then replaced after the anchor itself has been either repaired or replaced.

Another problem with known rope anchors is that they undergo extensive damage when they are subjected to excessive forces, as for example when a number of pool occupants sit or jump on a lane marker. Such extensive damage frequently requires that the entire rope anchor be replaced. The expense involved in making such replacements can be quite high, particularly when the rope anchors are fabricated of corrosive resistant metal such as stainless steel.

It is, accordingly, a general object of the present invention to provide a novel and improved rope anchor which either obviates or at the very least substantially minimizes all of the problems mentioned above.

A more specific object of the present invention is the provision of a rope anchor which is adapted to be easily and quickly mounted in place without the need of skilled tradesmen, and which is further adapted to be easily and quickly dismantled in the event that repairs become necessary.

Another object of the present invention is the provision of a rope anchor, the major component of which comprises a molded one-piece non-metallic body which is not susceptible to damage by the exertion of excessive force on a lane marker or other rope-like device connected to the anchor.

A further object of the present invention is the provision of a rope anchor having an anchor link which is movable between an operative readily accessible position protruding partially into the pool, and an inoperative position fully retracted into the anchor body, the latter having a front flange lying flush against the wall supporting the rope anchor.

These and other objects and advantages of the present invention will become more apparent as the description proceeds with the aid of the accompanying drawings wherein.

Figure 1:
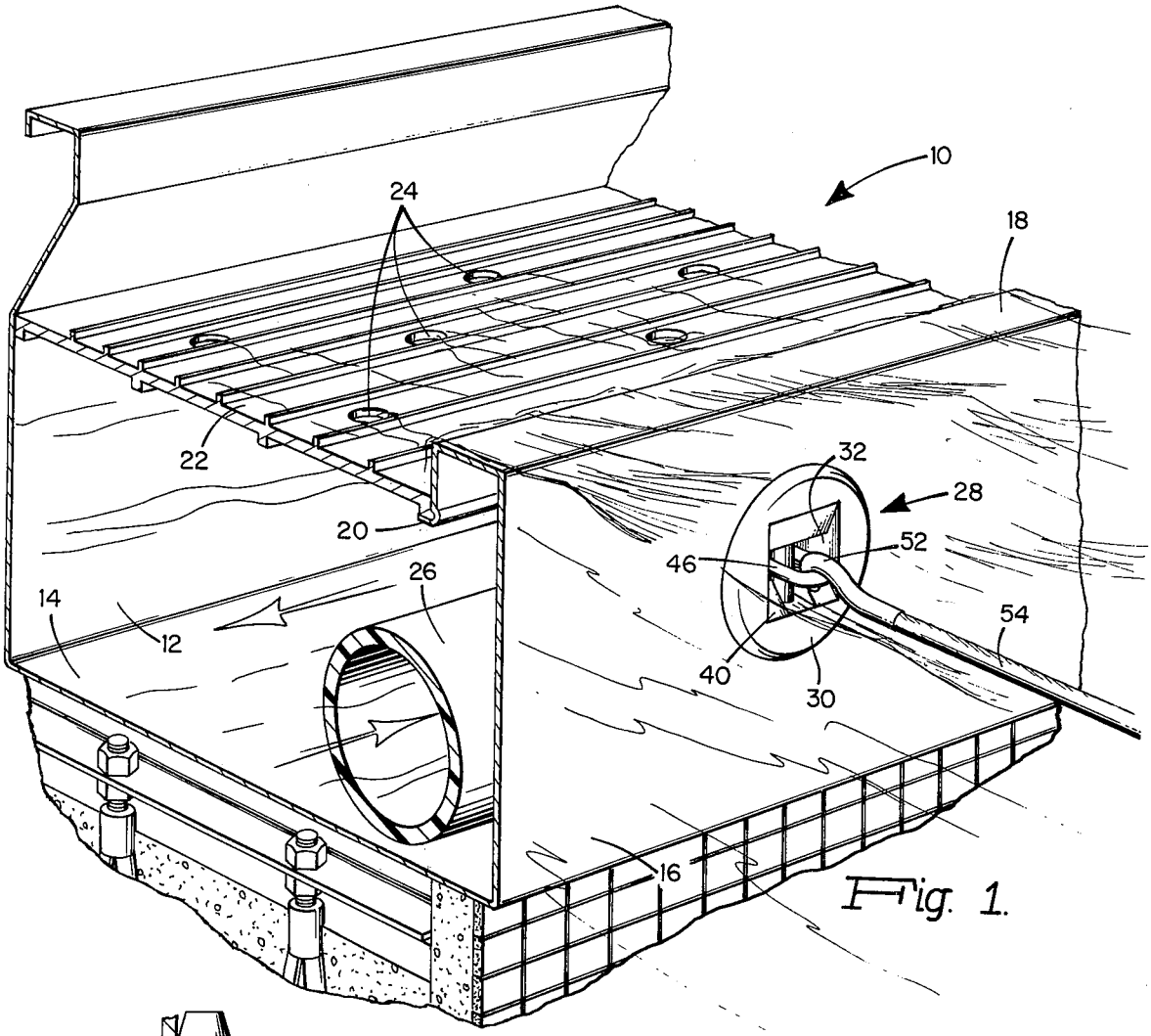
FIG. 1 is a view in perspective of a rope anchor in accordance with the present invention mounted on the inner wall of a typical metal overflow gutter.

Referring now to the drawings, there is generally indicated at 10 an overflow gutter and water supply system of the type employed around the periphery of a swimming pool. A complete description of this device, which is now in widespread use, is provided in applicant's U.S. Pat. No. 3,432,867. The gutter body is fabricated of sheet metal, preferably stainless steel, and has an outer wall 12, a bottom wall 14, and an inner vertical wall 16 having at its upper end an overflow lip 18 and an inwardly extending flange 20. The flange 20 cooperates with any suitable support (not shown) on the outer wall 12 to carry a removable perforated cover 22. Water is skimmed from the pool surface over the lip 18 onto the cover 22, from where it flows downwardly through the cover holes 24 into the gutter channel for removal to a remote filtering means. Filtered water is returned through an inlet manifold 26 and nozzles (not shown) which pass through the inner gutter wall 16 at locations spaced around the periphery of the pool.

The present invention is directed to the rope anchor generally indicated at 28. The rope anchor includes an anchor body having a front flange 30 surrounding an opening 32, and a back section 34 forming a recess 36 which is accessible through the opening 32. The back section 36 is adapted to protrude through a suitably dimensioned hole 38 in the inner gutter wall 16. The extent of this inward protrusion is limited by engagement of the front flange 30 with the outer surface of the gutter wall 16.

A pair of laterally spaced ledges 40 are provided in the recess 36. The ledges 40 have upper surfaces 42 which are inclined downwardly relative to the vertical face 44 of the front flange 30.

An anchor link 46 is located in the recess 36. A removable pin 48 is inserted through aligned holes 50 in the back section 34. When thus inserted, the pin 48 extends through the recess 36 and the anchor link 46 located therein, with the opposite ends of the pin protruding from opposite sides of the back section to cooperate with the front flange 30 in gripping the gutter wall 16 therebetween. The anchor link 46 and pin 48 are preferably made of stainless steel, while the anchor body is preferably molded as a single piece from a suitable non-metallic material such as glass filled nylon, plastic or the like.

To install the rope anchor 28, the only advance preparation required is the location of a suitably dimensioned hole 38 in an upstanding preferably vertical metal wall which conveniently although not necessarily can comprise the inner wall 16 of an overflow gutter 10. The back section 34 of the anchor body is simply inserted into the hole 38, bringing the flange 30 into contact with the outer surface of the gutter wall 16. The anchor link 46 is then placed in the recess 36, after which the pin 48 is driven through the aligned holes 50. It will be understood that the spacing between the aligned axes of the holes 50 and the interior face of flange 30 is such that when the pin is driven into place, the gutter wall 16 will be tightly gripped between the pin and the flange 30, and the flange 30 will be pulled into tight sealing engagement with the wall 16. To disassemble the rope anchor, one need only knock the pin 48 back out.

Figure 2:
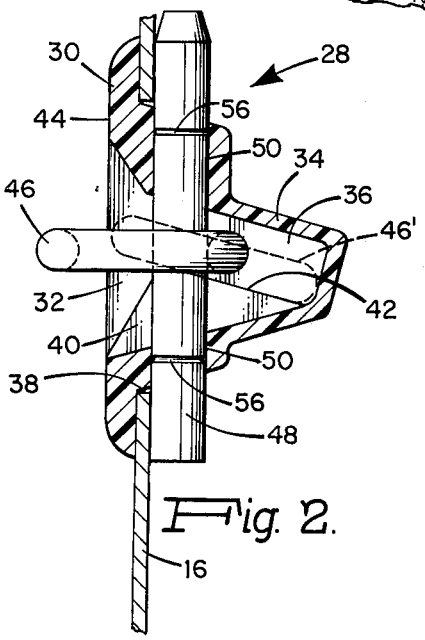
FIG. 2 is a vertical sectional view on an enlarged scale taken through the rope anchor shown in FIG. 1, with the lane marker detached therefrom; and, FIG. 3 is a rear elevational view of the rope anchor, with portions of the inner gutter wall broken away.
Figure 3:
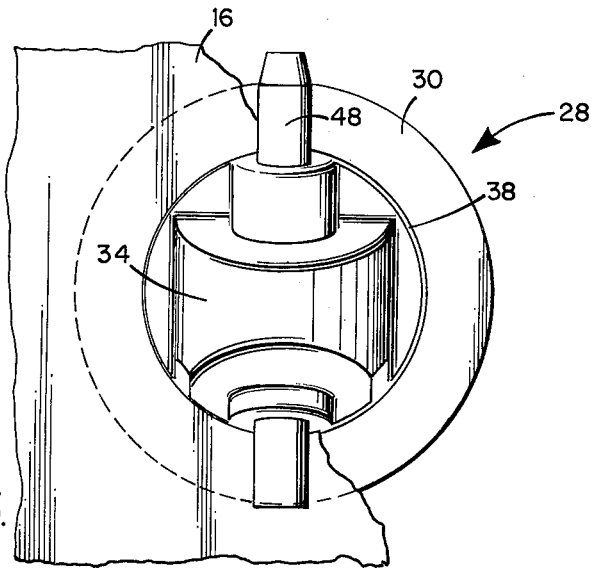

In use, the anchor link is pulled out to the position shown by the solid lines in FIGS. 1 and 2, and the hook 52 of a lane marker 54 is then connected thereto. Any force exerted by the lane marker 54 is transmitted through the hook 52 to the anchor link 46. The link 46 bears against the pin 40 which in turn bears against the inner surface of the gutter wall 16. Thus, the gutter wall becomes the primary structural element resisting any force exerted on the lane marker 54. To protect the gutter from being damaged by excessive force on the lane marker 54, the pin 48 is provided with appropriately spaced and dimensioned grooves 56 designed to lower the shear strength of the pin. Thus, if an excessive force is applied to the lane marker, for example as a result of a number of swimmers jumping thereon, the pin 48 will simply shear before any of the other components of the rope anchor or gutter are damaged. When this occurs, it is a simple matter for a pool attendant to quickly install a replacement pin, which is a relatively low cost item.

When the lane markers 54 are not being used, the anchor link 46 can be pushed into the recess 36 to an inoperative position shown in dotted at 46' in FIG. 2. When thus inopertively positioned, the link is fully contained in the recess 36 behind the face of the front flange 30. The downward slope of the upper ledge surfaces 42 urges the link to remain in this position until the rope anchor is to be placed in use again.

It is my intention to cover all changes and modifications of the embodiment herein chosen for purposes of disclosure which do not depart from the spirit and scope of the invention.

I claim:

1. For use on a metal wall at the periphery of a swimming pool, a rope anchor comprising: an anchor body having a front flange surrounding an opening, and a back section forming a recess which is accessible through said front opening, said back section being adapted to protrude through a suitably dimensioned hole in said wall, with said front flange being in engagement with one side of said wall around said hole; an anchor link in said recess; and a removable pin adapted for insertion through oppositely disposed openings in said back section, said pin when thus inserted extending through said recess and said anchor link with the opposite ends of said pin being arranged to engage the other side of said wall thereby cooperating with said front flange to hold the rope anchor in place on said wall.

2. The rope anchor as claimed in claim 1 wherein said anchor link is movable relative to said anchor body and said pin between an operative position extending through said front opening and partially beyond the face of said front flange, and an inoperative position contained within said recess and behind the face of said front flange.

3. The rope anchor as claimed in claim 2 further characterized by ledge means in said recess for supporting said anchor link, said ledge means being inclined relative to said front flange to thereby urge said anchor link into said inoperative position.

4. The rope anchor as claimed in claim 3 wherein said anchor body is comprised of a molded one-piece construction.

5. The rope anchor as claimed in claim 4 wherein said anchor body is molded of a non-metallic material.

6. The rope anchor as claimed in claim 1 wherein said pin is grooved to lower the shear resistance thereof.

7. For use with an overflow gutter surrounding the periphery of a swimming pool, the said gutter having an inner vertical metal wall terminating in an upper lip over which water is skimmed from the pool surface, a rope anchor for use with said gutter, said anchor comprising: a one-piece molded anchor body having a front flange surrounding a front opening which leads to a recess in a back section protruding rearwardly from said front flange, said back section being adapted to be received in a hole in the vertical metal wall of the gutter; an anchor link in said recess; and a removable pin adapted for insertion through said back section and the anchor link in said recess, the ends of said pin when thus inserted cooperating with said front flange to grip the vertical metal wall of the gutter therebetween.

* * * * *